United States Patent [19]

Sroub

[11] 4,213,650

[45] Jul. 22, 1980

[54] GLIDER

[75] Inventor: Joseph W. Sroub, Parma, Ohio

[73] Assignee: Production Experts, Inc., Cleveland, Ohio

[21] Appl. No.: 1,182

[22] Filed: Jan. 5, 1979

[51] Int. Cl.[2] ..... A47D 13/10; A47C 7/00

[52] U.S. Cl. ..... 297/281; 297/440

[58] Field of Search ..... 5/103, 124; D6/54; 297/273, 281, 282, 440

[56] References Cited

U.S. PATENT DOCUMENTS

| | | | |
|---|---|---|---|
| D. 147,766 | 10/1947 | Smith | D6/54 |
| 2,311,482 | 2/1943 | Smith | 297/281 X |
| 3,708,204 | 1/1973 | Wachsman | 297/400 |

FOREIGN PATENT DOCUMENTS

| | | | |
|---|---|---|---|
| 929238 | 7/1947 | France | 297/440 |

*Primary Examiner*—James C. Mitchell

*Attorney, Agent, or Firm*—Isler and Ornstein

[57] ABSTRACT

A glider is disclosed of durable construction, especially adapted for rugged outdoor use, as for example, on patios, porches and lawns. The glider is of comfortable, portable light weight construction consisting of a minimum number of parts which can be packaged in a relatively small space or container for shipping purposes, and can be quickly and easily assembled by unskilled persons, without the aid of tools, other than conventional or easily available tools such as a screw driver or small wrench. The glider embodies, in its construction, tubular members of simple, easily manufactured design, and wooden members made of readily available sizes of lumber. A feature of the invention is the provision of novel or unique means for supporting the glider on a support frame and constraining the glider to movement in a direction generally parallel to the floor on which the support frame is mounted, as well as the provision of means for reducing wear and noise caused by movement of the glider.

5 Claims, 12 Drawing Figures

GLIDER

This invention relates as indicated, to a glider, but is directed more particularly to a glider designed for rugged outdoor use, as for example, on patios and porches or on lawns.

A primary object of the invention is to provide a glider of the character described, which is durable and comfortable, and of portable, light weight design.

Another object of the invention is to provide a glider of the character described which consists of a minimum number of parts which can be packaged in a relatively small space or container for shipping purposes, and can be quickly and easily assembled by unskilled persons, without the aid of tools, other than conventional or easily available tools such as a screw driver or small wrench.

A further object of the invention is to provide a glider of the character described, which embodies in its construction tubular members of simple, easily manufactured design, and wooden members made of readily available sizes of lumber.

A further object of the invention is to provide a glider of the character described, having novel or unique means for supporting the glider on a support frame and constraining the glider to movement in a direction generally parallel to the floor on which the support frame is mounted.

A still further object of the invention is to provide a glider of the character described, in which noise and wear caused by movements of the glider are reduced to a minimum or virtually eliminated.

Other objects and advantages of my invention will be apparent during the course of the following description.

In the accompanying drawings forming a part of this specification, and in which like numerals are employed to designate like parts throughout the same, FIG. 1 is a perspective view of the glider;

Figure 1:
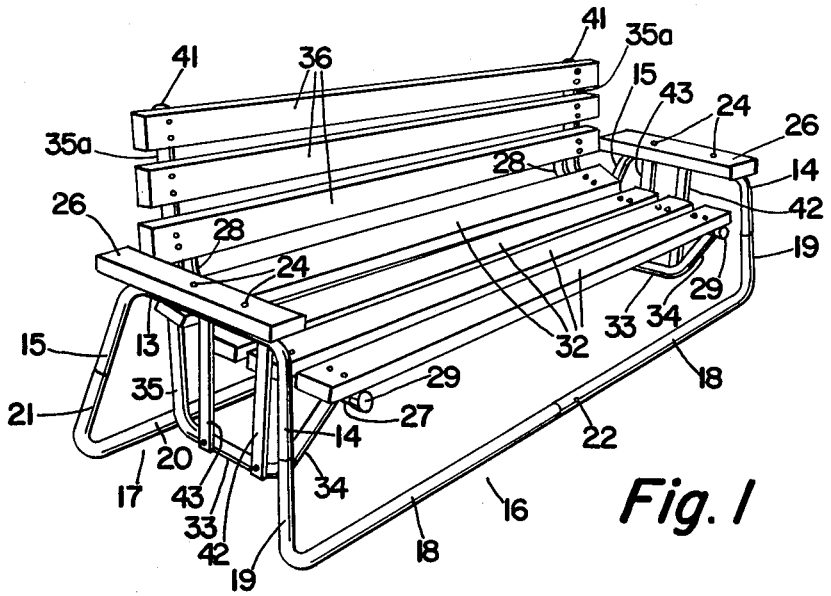

Referring more particularly to the drawings, a support frame for the glider is provided, comprising a pair of longitudinally-spaced inverted U-shaped members, each consisting of a horizontal portion 13 and downwardly extending divergent arms 14 and 15. Each of these members is made of 1½" diameter, 16 gauge welded steel tubing.

The glider support frame further comprises a pair of transversely-spaced U-shaped support bases, generally designated by reference numerals 16 and 17.

The support base 16 is preferably made in two sections, each comprising a horizontal portion 18 and an upright portion 19.

The support base 17 is similarly made in two sections, each comprising a horizontal portion 20 and an upright portion 21.

The support bases 16 and 17 are made of 1½" diameter, 16 gauge welded steel tubing.

Figure 10:
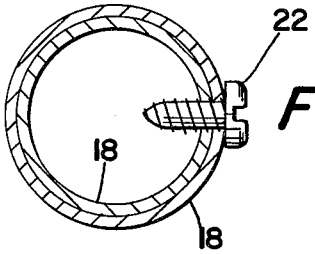
FIG. 10 is a cross-sectional view taken on the line 10—10 of FIG. 3.

In assembling the two sections of the support base 16, one end of the portion 18 of one of the sections is swaged to fit into one end of the portion 18 of the other section, and is connected to the latter by means of a screw 22, as best shown in FIG. 10.

In assembling the two sections of the support base 17, one end of the portion 20 of one of the sections is swaged to fit into one end of the portion 20 of the other section, and is connected to the latter by means of a screw 23, similar to the screw 22 (see FIG. 10).

Figure 11:
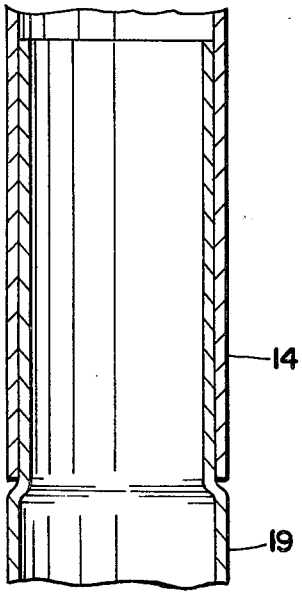
FIG. 11 is a fragmentary cross-sectional view taken on the line 11—11 of FIG. 5.

The portions 19 of the support base 16 are adapted to be connected to the arms 14 of the glider support frames and, for this purpose the upper ends of the portions 19 are swaged to have a slide or slip fit into the arms 14, as best shown in FIG. 11.

Similarly, the portions 21 of the support base 17 are adapted to be connected to the arms 15 of the glider support frame and, for this purpose the upper ends of the portions 21 are swaged to have a slide or slip fit into the arms 15, in the same manner that the portions 19 fit into the arms 14 (see FIG. 11).

Secured to the horizontal portions 13 of the glider support frame members, as by means of carriage bolts 24 and nuts 25, are arm rests 26 (see FIG. 7), each of which is made of a length of 2"×4" lumber.

The glider per se comprises a pair of longitudinally-spaced seat members, each formed from a length of 1½" diameter, 16 gauge, welded steel tubing bent to provide a slightly inclined seat supporting portion 27 and a rear back supporting portion 28 extending at an angle of approximately 81 degrees to the portion 27.

The portions 27 are provided at their forward ends with protective caps 29.

The portions 27 of these members have secured thereto, as by means of carriage bolts 30 and nuts 31, spaced slats 32 made of lengths of 2"×4" lumber and providing a seat for the glider.

Figure 9:
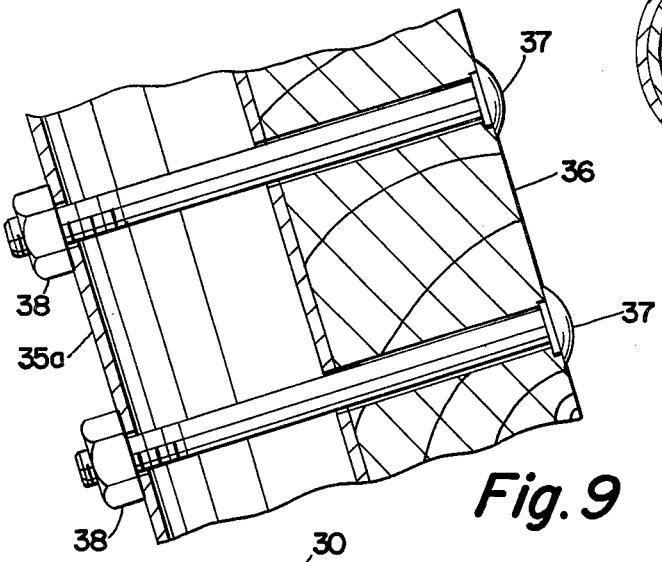
FIG. 9 is a fragmentary cross-sectional view taken on the line 9—9 of FIG. 3.

The glider per se further comprises a pair of seat bottom members, each formed from a length of 1½" diameter, 16 gauge, welded steel tubing, bent to provide a base portion 33, and divergent upwardly extending arms 34 and 35, one of which has an extension **35*a*, which provides a back support for the glider, to which spaced slats 36, made of lengths of 2"×4" lumber are secured, as by carriage bolts 37 and nuts 38 (FIG. 9**), to provide a back for the glider.

Figure 12:
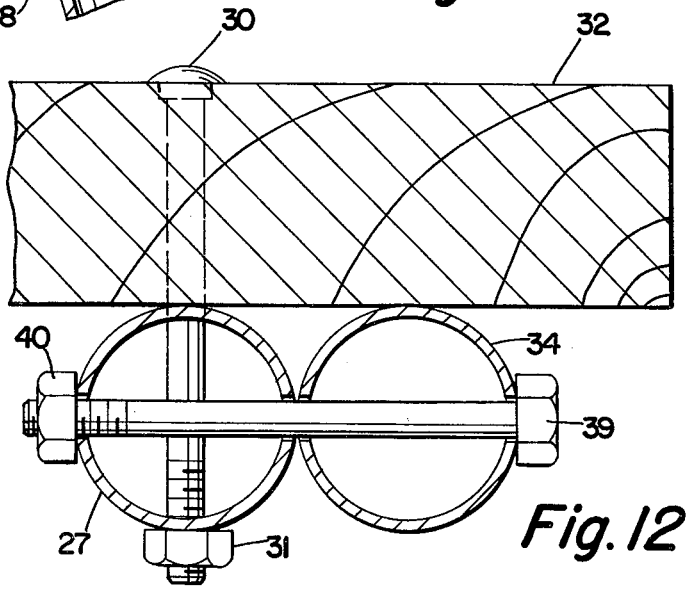
FIG. 12 is a fragmentary cross-sectional view taken on the line 12—12 of FIG. 6.

As best shown in FIG. 12, the arms 34 of the seat bottom members are secured to the front portions 27 of the seat members by means of bolts 39 and nuts 40. The arms 35 of the seat bottom members are secured in a similar manner to the rear portions 28 of the seat members.

The extensions **35*a* are provided at their upper ends with protective caps 41**.

For the purpose of suspending the glider per se on the support frame and at the same time constraining the glider per se to forward and backward movement in a substantially rectilinear direction, generally parallel with the floor on which the glider support frame is supported, pairs of braces 42 and 43 are provided at each end of the glider, as best seen in FIGS. 1, 2, 3, 4, 5, 6, 7 and 8.

Figure 3:
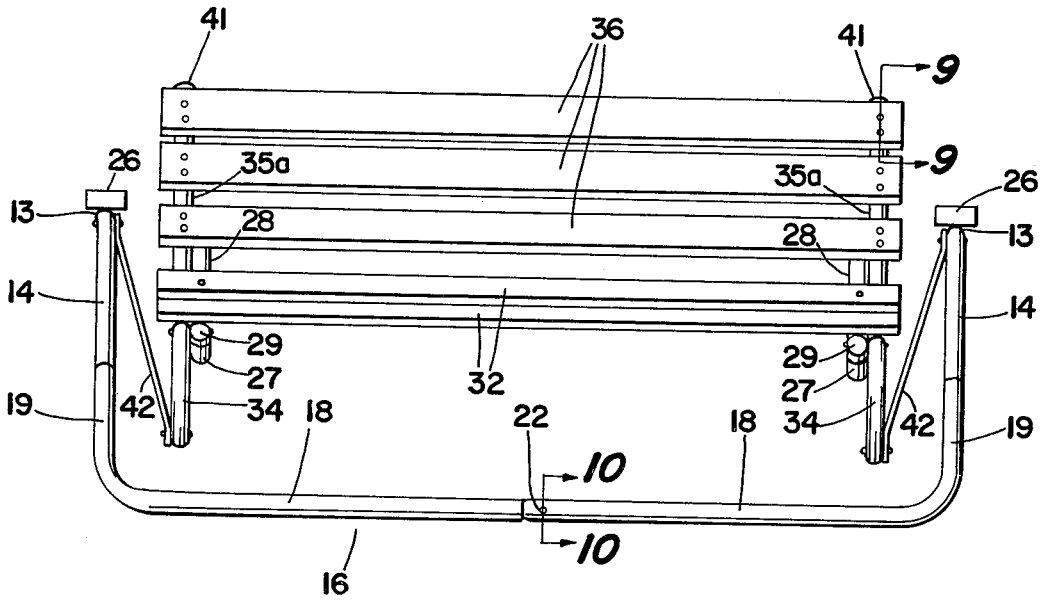
FIG. 3 is a front elevational view of the glider.
Figure 4:
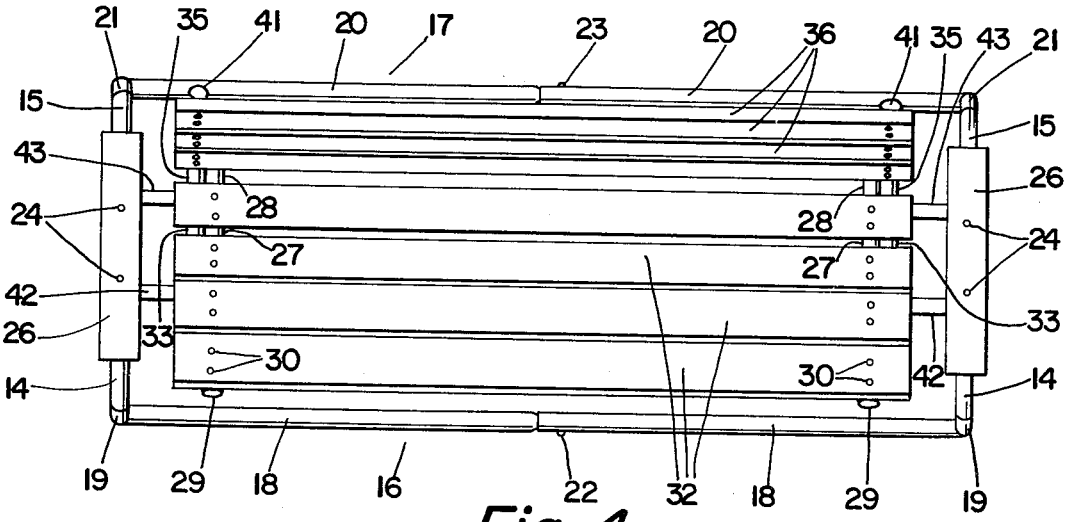
FIG. 4 is a top plan view of the glider.
Figure 5:
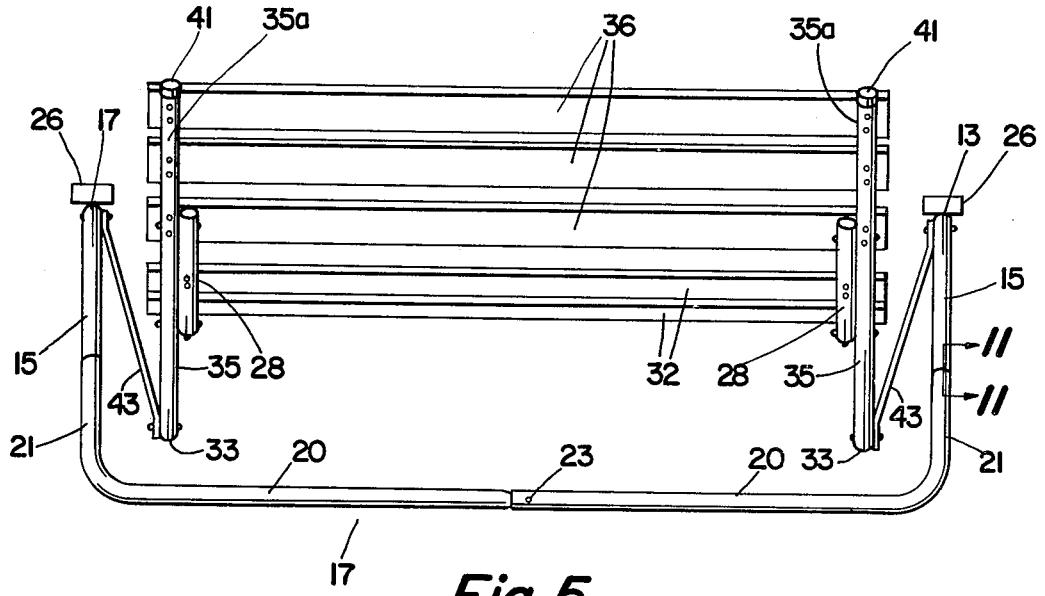
FIG. 5 is a rear elevational view of the glider.
Figure 6:
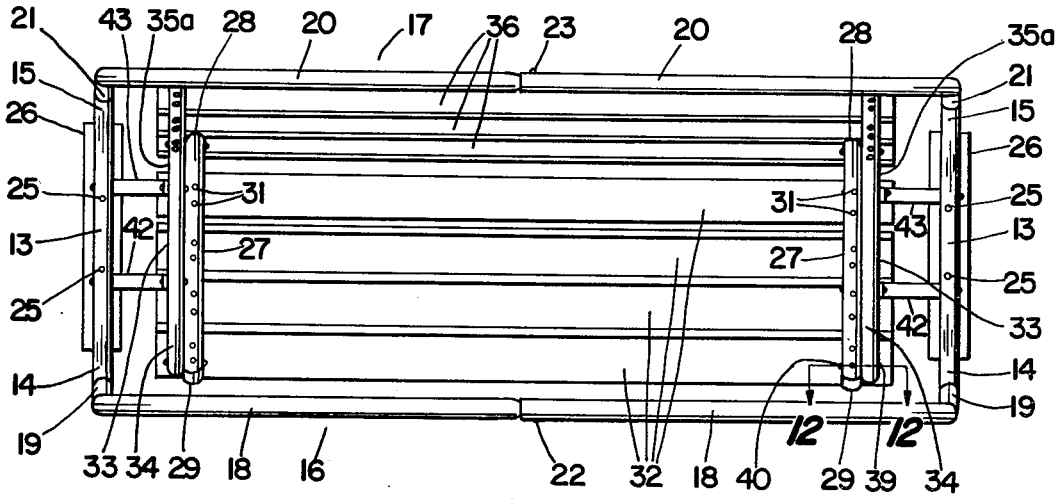
FIG. 6 is a bottom plan view of the glider.

Each brace is made from steel strip ⅝" thick and 1" wide, bent to provide ends which lie in offset parallel planes, as shown in FIGS. 3 and 5.

Figure 2:
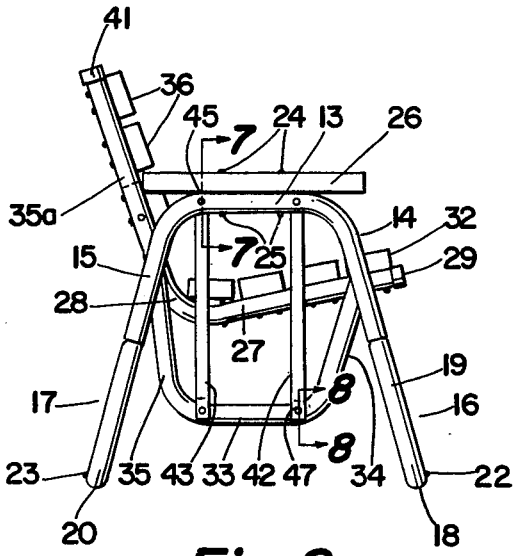
FIG. 2 is a side elevational view of the glider.
Figure 7:
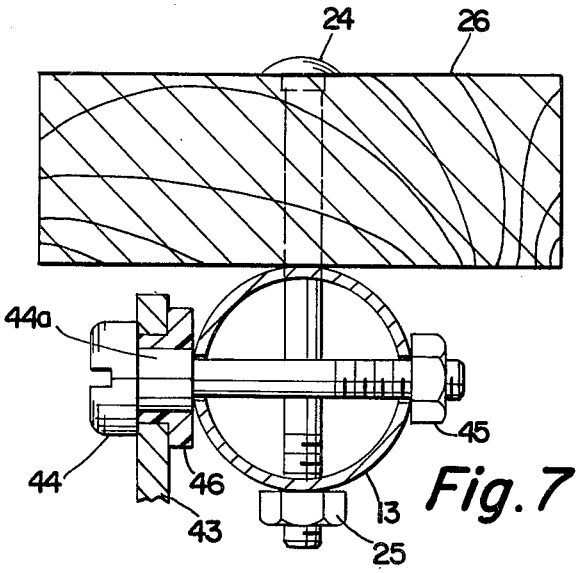
FIG. 7 is a fragmentary cross-sectional view taken on the line 7—7 of FIG. 2.

The upper ends of the braces are pivotally secured to bolts 44 which extend through the horizontal portions 13 of the support frame, and have nuts 45 secured thereto as best seen in FIGS. 2 and 7.

The portion 44*a* of the bolt 44 adjacent the head of the bolt is of somewhat larger diameter than that of the openings in the portions 13, and a bushing 46 made of Nylon or like material, is interposed between the braces and the portions 44*a* of the bolts to reduce or eliminate wear and noise caused by the movement of the glider.

Figure 8:
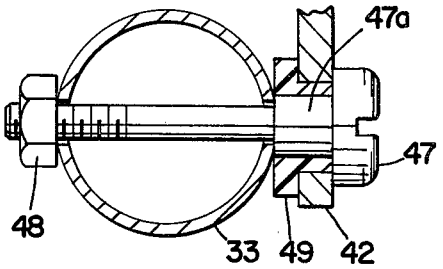
FIG. 8 is a fragmentary cross-sectional view taken on the line 8—8 of FIG. 2.

The lower ends of the braces are pivotally secured to bolts 47, which extend through the base portions 33 of the glider seat bottom members and have nuts 48 secured thereto, as best seen in FIGS. 2 and 8.

The portion 47*a* of the bolt 47 adjacent the head of the bolt is of somewhat larger diameter than that of the openings in the portion 33, and a bushing 49, made of Nylon or like material is interposed between the braces and the portions 47*a* of the bolts to reduce or eliminate wear and noise caused by movements of the glider.

The braces 42 and 43 together with the portions 13 and 33 to which they are pivotally secured, form parallelograms, which constrain the glider to move forwardly and rearwardly in a substantially rectilinear direction generally parallel with the floor on which the glider support frame is supported.

It is thus seen that I have provided a glider which fulfills all of the stated objects of the invention, and at the same time, is handsome and attractive in appearance.

It is to be understood that the forms of my invention, herewith shown and described, are to be taken as preferred examples of the same, and that various changes may be made in the shape, size and arrangement of parts thereof, without departing from the spirit of the invention or the scope of the subjoined claims.

Having thus described my invention, I claim:

1. In a glider of the character described, a glider seat and back having spaced, longitudinally extending slats, longitudinally-spaced tubular members supporting said slats, and a support frame for said glider seat and back, said frame comprising transversely-spaced tubular U-shaped members disposed in planes which converge toward each other in an upward direction, each of said U-shaped members having a longitudinally-extending floor engaging portion parallel with said slats, and longitudinally-spaced tubular inverted U-shaped members having downwardly-extending divergent arms in alignment with the arms of said transversely-spaced U-shaped members and connected thereto.

2. A glider as defined in claim 1, including arm rests mounted on and secured to said inverted U-shaped members.

3. In a glider of the character described, a glider seat and back comprising spaced parallel slats, extending longitudinally of said glider, first tubular members extending transversely of said seat slats and underlying and supporting said seat slats, and having rear portions extending angularly to said tubular members and underlying and supporting at least one of said back slats, second tubular members disposed adjacent said first-named members and comprising base portions and divergent upwardly extending arms, one of which has an extension disposed rearwardly of and providing a support for said back slats, a support frame for said glider seat and back, said support frame comprising transversely-spaced U-shaped tubular members disposed in planes which converge toward each other in an upward direction, each of said U-shaped members having a longitudinally-extending floor-engaging portion parallel with said slats, said support frame further comprising longitudinally-spaced inverted U-shaped tubular members having downwardly extending divergent arms in alignment with the arms of said transversely-spaced U-shaped members and connected thereto, and means pivotally connected to said inverted U-shaped members, and said second-named tubular members for constraining movement of said seat and back in a direction generally parallel to the floor on which said glider is mounted.

4. A glider, as defined in claim 3, wherein said means comprises pairs of parallel metal straps.

5. A glider, as defined in claim 4, wherein said straps are pivotally and removably connected to said seat and back tubular members and to said inverted U-shaped members by means of bolts and nuts, and bushings of non-metallic material are interposed between said straps and bolts to reduce wear and noise.

* * * * *

UNITED STATES PATENT AND TRADEMARK OFFICE

CERTIFICATE OF CORRECTION

PATENT NO. : 4,213,650

DATED : July 22, 1980

INVENTOR(S) : Joseph W. Sroub

It is certified that error appears in the above—identified patent and that said Letters Patent is hereby corrected as shown below:

The name of the assignee should read

-- Cardinal American Corporation --.

Signed and Sealed this

Eleventh Day of November 1980

[SEAL]

Attest:

SIDNEY A. DIAMOND

Attesting Officer

Commissioner of Patents and Trademarl